US006701584B2

(12) United States Patent
Metzger

(10) Patent No.: US 6,701,584 B2
(45) Date of Patent: Mar. 9, 2004

(54) ZIPPER GUARD

(75) Inventor: Andrew Metzger, Belle Plaine, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 10/104,561

(22) Filed: Mar. 21, 2002

(65) Prior Publication Data

US 2003/0177615 A1 Sep. 25, 2003

(51) Int. Cl.[7] ..... A44B 19/00
(52) U.S. Cl. ..... 24/415; 24/426
(58) Field of Search ..... 24/410, 415, 426, 24/427, 428, 385, 430, 431, 436

(56) References Cited

U.S. PATENT DOCUMENTS

| | | | | | |
|---|---|---|---|---|---|
| 1,813,227 | A | | 7/1931 | Blair | |
| 2,056,172 | A | | 10/1936 | De Vore | |
| D118,050 | S | | 12/1939 | Lawson | |
| 2,295,976 | A | | 9/1942 | Suskowitz et al. | |
| 2,379,059 | A | | 2/1945 | Marinsky | |
| 2,568,163 | A | | 9/1951 | Morin | |
| 2,677,162 | A | | 5/1954 | Foltis | |
| 2,792,611 | A | | 5/1957 | Morin | |
| 2,799,909 | A | | 7/1957 | Dellaquila | |
| 2,807,853 | A | | 10/1957 | Chery | |
| 2,819,505 | A | * | 1/1958 | Marcellus | 24/426 |
| 2,824,352 | A | | 2/1958 | Foltis | |
| 2,840,877 | A | * | 7/1958 | Foltis | 24/426 |
| 2,855,652 | A | | 10/1958 | Jones | |
| 2,866,245 | A | | 12/1958 | Elgin | |
| 2,933,792 | A | | 4/1960 | Malmborg | |
| 3,337,929 | A | | 8/1967 | McGahee | |
| 3,497,926 | A | | 3/1970 | Frohlich | |
| 3,604,070 | A | | 9/1971 | Vorsteher | |
| 3,822,443 | A | | 7/1974 | Yoshida | |
| 3,857,125 | A | | 12/1974 | Hunt | |
| 3,959,834 | A | | 6/1976 | Hunt | |
| 4,023,244 | A | | 5/1977 | Doguchi et al. | |
| D245,046 | S | | 7/1977 | Weikal | |
| 4,238,871 | A | | 12/1980 | Cannon | |
| 4,261,082 | A | | 4/1981 | Kamiya | |
| 4,819,308 | A | * | 4/1989 | Baroky | 24/415 |
| 4,997,222 | A | | 3/1991 | Reed | |
| D325,007 | S | | 3/1992 | Komuro | |
| 5,110,383 | A | | 5/1992 | Kramer | |
| 5,181,299 | A | | 1/1993 | Huang | |
| 5,497,535 | A | | 3/1996 | Kloor | |
| D380,988 | S | | 7/1997 | Mizuno | |
| D406,251 | S | | 3/1999 | Nakamura | |
| 6,026,547 | A | * | 2/2000 | O'Donnell Kiely | 24/433 |
| 6,490,770 | B1 | | 12/2002 | Matsuda et al. | |
| 6,510,590 | B1 | * | 1/2003 | Lin | 24/66.9 |

* cited by examiner

*Primary Examiner*—Anthony Knight
*Assistant Examiner*—André L. Jackson
(74) *Attorney, Agent, or Firm*—Leydig, Voit & Mayer, Ltd.

(57) ABSTRACT

A zipper guard is formed as a one-piece homogeneous plastic molding. Resilient hooks or latches are formed on the zipper guard to provide a simple snap-fit interconnection between lugs on a zipper slide and two pairs of engagement legs on the zipper guard. The zipper guard may be retrofitted to existing zipper slides or fitted to new zipper slides.

16 Claims, 2 Drawing Sheets

FIG 1
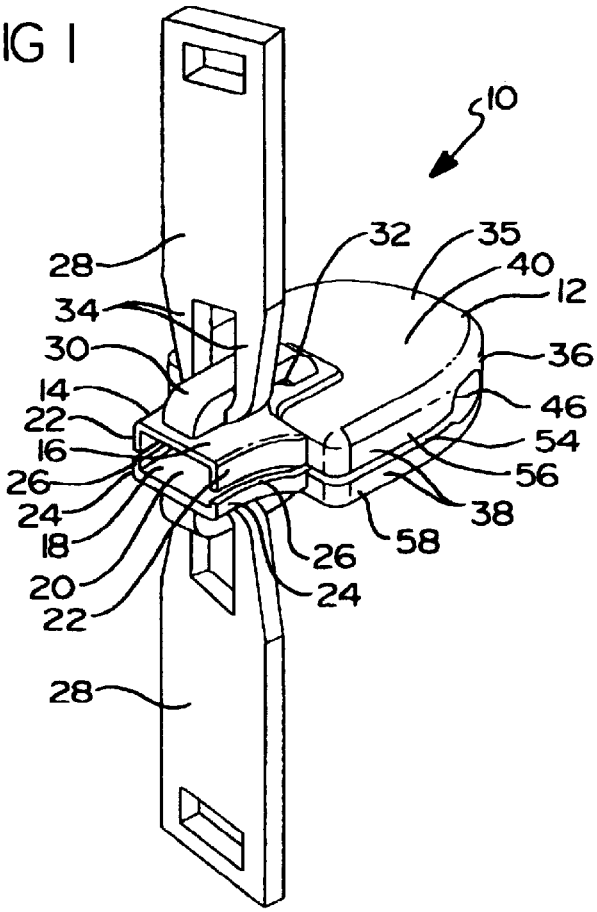
FIG 3
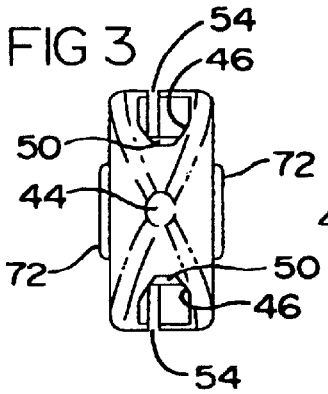
FIG 2
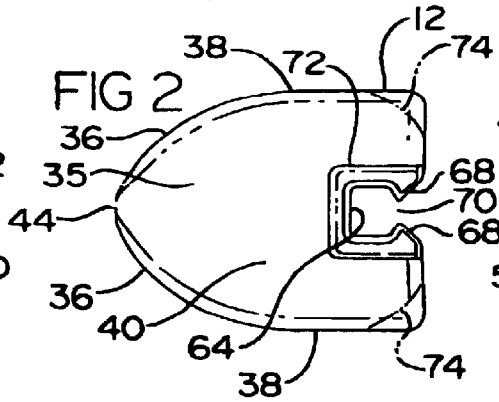
FIG 4
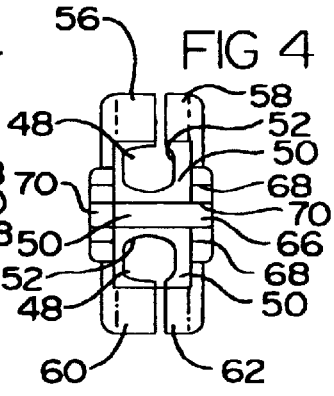
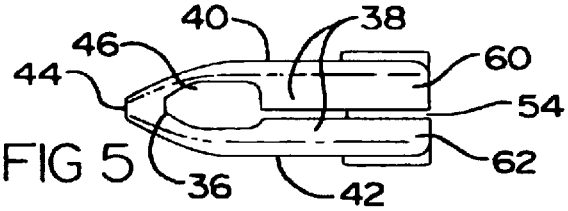
FIG 5

FIG 8
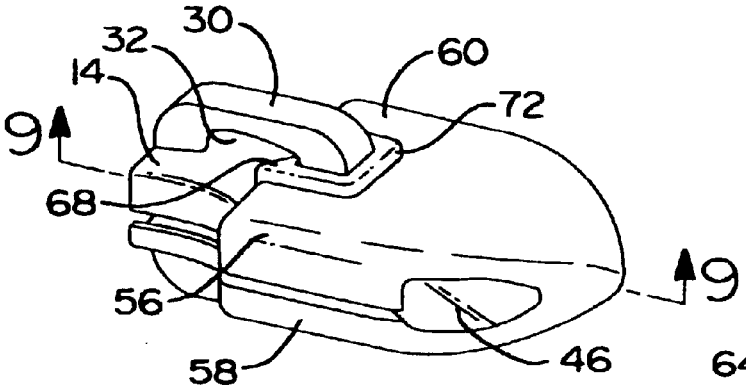
FIG 6
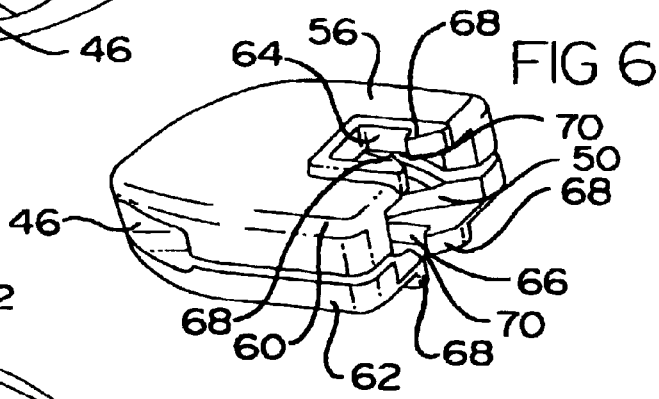
FIG 7
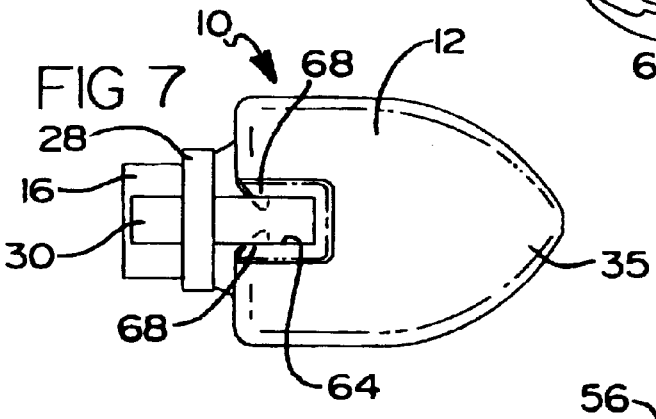
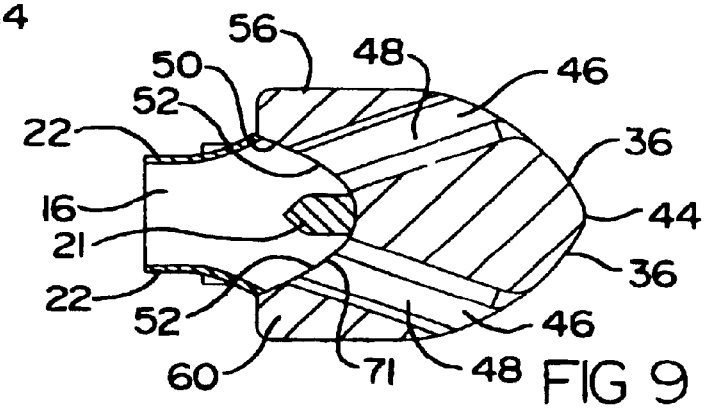
FIG 9

ZIPPER GUARD

BACKGROUND OF THE INVENTION

1. Field of the Invention

The present invention relates in general to an attachment to a zipper slide for reducing zipper snags, and relates in particular to a one-piece attachment which may be snap-fit or molded to a zipper slide.

2. Description of Prior Developments

Guides for zipper slides have been developed for the purpose of minimizing snags between the zipper slide, zipper teeth and surrounding fabric material, as well as snags with other objects which may become lodged between the zipper slide and the zipper teeth. Although these guards provide adequate performance, their structure can be somewhat complicated and the guards can be difficult to mount on the zipper slides. An example of such a zipper guard is shown in U.S. Pat. No. 4,819,308, which is incorporated herein by reference.

Accordingly, a need exists for a guard for a zipper slide which is easy to mount, inexpensive to fabricate and install, and which can be quickly and easily applied to new zippers or retrofitted to existing zippers.

SUMMARY OF THE INVENTION

The present invention has been developed to meet the needs noted above, and therefore has as an object the provision of a guard for a zipper slide which is easy to mount on a zipper slide and which is inexpensive to manufacture.

A further object of the invention is to provide a guard for a zipper slide which can be quickly and easily retrofitted to existing zipper slides.

These and other objects are met by the present invention which is directed to a one-piece homogeneous plastic molded guard for a zipper slide. The guard includes a resilient snap-fit mounting which allows the guard to be quickly and easily mounted to a lug or lugs typically provided on conventional zipper slides.

By molding the entire guard as a single one-piece homogeneous molding, the cost of the guard is minimized. Moreover, no assembly of components is required to construct the one-piece guard. It is quickly and easily applied with a simple snap-fit mounting to a zipper slide, either at the time the zipper is fabricated or retrofitted on an existing zipper.

A particular advantage of the present invention is its simple one-piece molded construction which minimizes its cost and facilitates its mounting on a zipper slide. Another advantage of the present invention is the provision of a simple snap-fit mounting which positively secures the guard to a lug or lugs present on most zipper slides.

The aforementioned objects, features, and advantages of the invention will, in part, be pointed out with particularity, and will, in part, become clear from the following more detailed description of the invention taken in conjunction with the accompanying drawings, which form an integral part thereof.

BRIEF DESCRIPTION OF THE DRAWINGS

In the drawings:

FIG. 1 is a top right rear perspective view of a zipper guard constructed in accordance with the invention and fitted to a conventional zipper slide;

FIG. 2 is a top plan view of the zipper guard of FIG. 1;

FIG. 3 is a front view of FIG. 2;

FIG. 4 is a rear view of FIG. 2;

FIG. 5 is a left side elevation view of FIG. 2;

FIG. 6 is a top left rear perspective view of the zipper guard of FIG. 2;

FIG. 7 is a top view of FIG. 1;

FIG. 8 is a top right front perspective view of the zipper guard and zipper slide of FIG. 1, with the pull tabs removed from the zipper slide for clarity; and FIG. 9 is a view in central section taken along line 8–8 of FIG. 8.

In the various views of the drawings, like reference characters designate like or similar parts.

DETAILED DESCRIPTION OF THE PREFERRED EMBODIMENTS

The present invention will now be described in conjunction with the drawings beginning with FIG. 1, which shows a zipper slide assembly 10 constructed in accordance with the invention. Slide assembly 10 includes a guard body member 12 connected to a conventional zipper slide 14.

The zipper slide 14 includes a first or upper slide plate 16 connected to a second or lower slide plate 18 which together define a central channel 20 through which zipper teeth are guided in a known fashion. As seen in FIG. 9, a post 21 interconnects the upper and lower slide plates 16, 18. Pairs of first and second sidewalls 22, 24 respectively extending toward one another from the first and second plates 16, 18 define a pair of longitudinally-extending slots 26. The slots 26 allow for the passage of fabric strips to which the rows of zipper teeth are connected.

In the example of FIG. 1, zipper slide 14 is shown fitted with a pair of pull tabs 28. Each pull tab 28 is pivotally connected to a pull tab lug 30 extending outwardly from a central portion of each slide plate 16, 18. While two pull tabs are shown, the guard body member 12 can be readily connected to a zipper slide having only a single pull tab 28.

Lugs 30 are generally arcuate or arch-shaped members extending above and over their respective slide plates so as to respectively form a pair of openings or sockets 32 between the lugs and slide plates. A pair of arms 34 on each pull tab 28 is pivotally anchored within the sockets 32 in a known fashion.

As further seen in FIGS. 1 and 7–9, guard body member 12 is connected to and projects forwardly from the front end of the zipper slide 14. Guard body member 12 is preferably formed as a one-piece homogeneous plastic molding. The plastic is selected to have significant abrasion resistance.

A particularly suitable plastic is acetyl plastic, but any other tough and somewhat resilient plastic can provide acceptable performance. Plastic is preferred to metals, as plastic will cause less wear on modern plastic zipper teeth than a similar guard formed of metal, and plastic can be easily and economically molded.

Guard body member 12 can be formed separately from the zipper slide 14 and later connected to the zipper slide with a snap-fit connection, as described below. Alternatively, guard body member 12 can be molded directly to the zipper slide 14 in, for example, an insert molding operation. In either case, by molding the guard member 12 as a single plastic part, it can be manufactured extremely economically.

As seen in FIGS. 1–6, the guard member 12 is formed with a tapered or rounded leading edge portion or nose portion 35 having forwardly converging front sidewalls 36. Sidewalls 36 diverge rearwardly to a pair of substantially parallel opposed rear split sidewalls 38. The front portions of the upper surface 40 and lower surface 42 of the guard body member 12 taper forwardly toward one another as they converge at the tip 44 of the nose portion 35.

In this manner, the nose portion 35 is formed as a compound wedge having a first wedge defined by forwardly converging front sidewalls 36 and by a second wedge defined by forwardly converging upper and lower surfaces 40, 42. This compound wedge acts as a plow to plow away fabric and other material that would otherwise cause a zipper snag if allowed to enter the front entrances 46 of the guard member 12 and then into the zipper slide 14.

As seen in FIGS. 2 and 5, the guard member 12 has a somewhat bullet shaped profile when viewed from above, below and from either side. As seen in FIGS. 3 and 4, the front and rear views define a generally rectangular profile.

A front entrance port or front opening 46 is formed in the guard body member 12 through each of the front sidewalls 36 to receive zipper teeth attached to a zipper strip. As seen in FIG. 9, each opening 46 extends rearwardly into an internal channel 48. The channels 48, 48 converge rearwardly toward one another and open rearwardly into a nest or pocket 50 via rear entrance ports or rear openings 52.

A longitudinally-extending slot 54 extends rearwardly from each front opening 46 along and through each rear sidewall 38. Each slot 54 extends inwardly from each sidewall 38 and opens into and communicates with each internal channel 48. The slots 54 align with the slots 26 on the zipper slide 14 to allow for the passage of a fabric strip on which zipper teeth are connected.

The internal channels 48 and slots 54 separate and divide the central and rear portions of the guard body member 12 into four rearwardly-extending cantilevered legs. One pair of legs 56, 58 extends along and over one side of pocket 50 and a second pair of legs 60, 62 extends along and over the opposite side of pocket 50. As seen in FIGS. 1 and 9, the legs act as zipper slide engagement members.

The rearward end portions of each pair of legs 56, 58 and 60, 62 are respectively separated by an open notch or socket 64, 66. Socket 64 extends from the upper surface 40 into pocket 50 and socket 66 extends from the lower surface 42 into pocket 50. Sockets 64, 66 are dimensioned to receive the lugs 30 with a close fit as seen in FIG. 7.

As seen in FIGS. 2, 6 and 8, in order to securely retain the guard body member 12 on the zipper slide 14, each leg 56, 58, 60, 62 is formed with an inwardly projecting cantilevered connector member, such as a hook or tooth 68. Each pair of laterally opposing teeth 68 defines a nip region 70 between them, at the entrance to each respective socket 64, 66.

Nip region 70 is dimensioned to receive lug 30 with a resilient over-center interference snap-fit. As the lugs 30 are pressed into the sockets 64, 66, they enter the nip regions 70 and cause the legs 56, 58, 60 and 62 to deflect slightly laterally outwardly toward their respective sidewalls 38. Once the lugs 30 pass through the nip regions 70, the teeth 68 resiliently snap inwardly into the openings or sockets 32 beneath the lugs 30 and act as resilient latches or hooks which securely and tightly hold the guard body member 12 on the zipper slide 14.

In this manner, the guard body 12 is securely connected and anchored to the zipper slide 14. As seen in FIG. 9, the pocket 50 within the guard body 12 has a contoured arched inner front surface which matches the contour of the front portion 71 of the zipper slide 14 so as to receive the zipper slide with a close secure interfit when the lugs 30 are embraced within the sockets 64, 66. Raised ribs 72 may be provided on the upper and lower surfaces 40, 42 around the sockets 64, 66 to provide strength and rigidity to the toothed latches 68.

There has been disclosed the best embodiment of the invention presently contemplated. However, it is to be understood that various changes and modifications may be made thereto without departing from the spirit of the invention, as defined by the appended claims. For example, the rear corners on each leg 56–62 can be chamferred, for example, along dash lines 74 as shown in FIG. 2. This gives the guard body member 12 a rearwardly tapering or converging boat tail profile which reduces interference with the surrounding material as the zipper slide moves rearwardly.

What is claimed is:

1. A guard for a zipper slide, said zipper slide having a lug having an opening and extending outwardly from said zipper slide, said guard comprising:

a guard body mountable to said zipper slide; and a snap-fit connector defined by said guard body and comprising a resilient latch including a cantilevered hook configured to extend into said opening and to snap onto said lug.

2. The guard of claim 1, wherein said connector comprises a pair of cantilevered hooks, each configured to extend into said opening.

3. The guard of claim 1, wherein said lug comprises a pull tab lug.

4. A zipper slide assembly, comprising:

a zipper slide comprising a top surface, a bottom surface and a pair of slotted sidewalls extending between said top and bottom surfaces;

a guard body mounted to said zipper slide, said guard body having a pocket formed therein and receiving said zipper slide; and a resilient snap-fit connector provided on said guard body, said connector comprising a latch disposed over at least said top surface of said zipper slide, the latch being movable in a direction parallel to the top surface to selectively engage and disengage the zipper slide, said latch comprising a cantilevered hook movable in a direction parallel with said top surface.

5. The zipper slide assembly of claim 4, wherein said latch comprises a pair of cantilevered hooks, each movable in a direction parallel with said top surface.

6. A guard for a zipper slide, said zipper slide having a lug extending outwardly from said zipper slide, said guard comprising:

a guard body mountable to said zipper slide and comprising a pair of legs; and a snap-fit connector fixed to said pair of legs and defined by said guard body for connecting said guard to said zipper slide, said snap-fit connector being configured and arranged to snap onto said lug.

7. The guard of claim 6, wherein said lug comprises a pull tab lug.

8. A zipper slide assembly, comprising:

a zipper slide comprising a top surface, a bottom surface, a pair of slotted sidewalls extending between said top and bottom surfaces, and a lug extending outwardly from said zipper slide, said lug comprising an opening;

a guard body mounted to said zipper slide, said guard body having a pocket formed therein and receiving said zipper slide; and a resilient snap-fit connector provided on said guard body, said connector comprising a latch disposed over at least said top surface of said zipper slide and engaged with said lug, said latch comprising a hook extending into said opening.

9. The zipper slide assembly of claim 8, wherein said lug comprises a pull tab lug.

10. A zipper slide assembly, comprising:

a zipper slide comprising a top surface, a bottom surface, a pair of slotted sidewalls extending between said top and bottom surfaces, and a pair of lugs respectively extending from said top and bottom surfaces;

a guard body mounted to said zipper slide, said guard body having a pocket formed therein and receiving said zipper slide; and a resilient snap-fit connector provided on said guard body, said connector comprising a latch disposed over at least said top surface of said zipper slide and, said latch comprising engagement members engaged with said pair of lug.

11. The zipper slide assembly of claim 10, wherein said lugs each comprise a pull tab lug.

12. A guard for a zipper slide, said zipper slick having a pull tab lug extending outwardly from said zipper slide, said guard comprising:

a guard body mountable to said zipper slide; and a snap-fit connector defined by said guard body for connecting said guard to said zipper slide, said snap-fit connector being configured and arranged to snap onto said pull tab lug.

13. The guard of claim 12, wherein said connector comprises a resilient latch configured to engage said pull tab lug.

14. The guard of claim 12, wherein said guard body comprises a molded plastic body and wherein said connector is formed homogeneously with said guard body.

15. A guard for a zipper slide, comprising:

a guard body mountable to said zipper slide, said guard body comprising a one-piece plastic molded body having a pocket formed therein for receiving said zipper slide; and a connector formed homogeneously with said guard body, said connector comprising a pair of zipper slide engagement members cantilevered around said pocket;

wherein said guard body further comprises a pair of slotted sidewalls, and wherein said pair of slide engagement members deflects laterally outwardly in the direction of said slotted sidewalls when engaging said zipper slide.

16. A zipper slide assembly, comprising:

a zipper slide comprising a top surface, a bottom surface, a pair of slotted sidewalls extending between said top and bottom surfaces, and a pull tab lug extending outwardly from said zipper slide;

a guard body mounted to said zipper slide, said guard body having a pocket formed therein and receiving said zipper slide; and a resilient snap-fit connector provided on said guard body, said connector comprising a latch disposed over at least said top surface of said zipper slide and engaged with said pull tab lug.

* * * * *